United States Patent [19]

Donovan

[11] Patent Number: 4,639,039

[45] Date of Patent: Jan. 27, 1987

[54] HEIGHT ADJUSTMENT MECHANISM FOR CHAIR BACKREST

[75] Inventor: Kyle P. Donovan, Brown Deer, Wis.

[73] Assignee: Milsco Manufacturing Company, Milwaukee, Wis.

[21] Appl. No.: 774,447

[22] Filed: Sep. 10, 1985

[51] Int. Cl.[4] ..... A47C 7/46

[52] U.S. Cl. ..... 297/353; 248/297.3; 297/410; 403/107

[58] Field of Search ..... 297/353, 410; 403/105, 403/330, 107; 248/297.3

[56] References Cited

U.S. PATENT DOCUMENTS

| | | | |
|---|---|---|---|
| 2,096,452 | 10/1937 | Eber | 403/105 X |
| 3,860,286 | 1/1975 | Rasmussen | 297/410 X |
| 4,012,158 | 3/1977 | Harper | 297/353 X |
| 4,384,742 | 5/1983 | Wioniewski | 297/353 |
| 4,451,084 | 5/1984 | Seeley | 297/353 |

*Primary Examiner*—Kenneth J. Dorner
*Assistant Examiner*—Peter Brown
*Attorney, Agent, or Firm*—James E. Nilles

[57] ABSTRACT

An adjustment mechanism is provided for manually positioning and releasably locking a chair backrest in a desired vertical position relative to the chair seat. The mechanism comprises a guide rigidly secured to an upright backrest support frame of a chair and a channel rigidly secured to the backrest. The channel is mounted for vertical sliding movement on the guide. The channel comprises a slot having a plurality of vertically arranged notches along one vertical edge of the slot, an inclined surface sloping downwardly from the lowest notch at the bottom end of the slot, and a cam surface, partially straight and partially curved, extending upwardly along the other vertical edge of the slot from the lower end of the inclined surface to the highest notch. A latch bar is pivotally mounted on a pivot pin on the guide and has a latch pin extending into the slot. A two-legged torsion spring mounted on the guide between the guide and channel biases the latch bar in a latched position wherein the latch pin releasably engages a notch to maintain the backrest at a selected height. Manually raising the backrest slightly above its highest latched position (lowest notch) engages the inclined surface with the latch pin to pivot the latch bar overcenter to spring-biased unlatched position. Then, manually lowering the backrest to its lowest position (highest notch) while the latch pin engages the curved portion of the cam surface pivots the latch bar from overcenter unlatched position back to a latched position wherein the latch pin engages the highest notch to maintain the backrest in its lowest position. From there, the backrest can be lifted one notch at a time to raised positions.

8 Claims, 8 Drawing Figures

HEIGHT ADJUSTMENT MECHANISM FOR CHAIR BACKREST

BACKGROUND OF THE INVENTION

1. Field of Use

This invention relates generally to mechanisms which enable components of a chair to be adjustably positioned relative to one another.

In particular, it relates to a backrest height adjustment mechanism which enables the backrest of a chair to be manually raised or lowered to a plurality of vertical positions relative to the chair seat and which releasably locks the backrest in a selected one of such positions.

2. Brief Description of the Prior Art

Prior art chair backrest height adjustment mechanisms of the aforesaid character take various forms. In some, a manually operable screw releasably secures a slidably adjustable backrest at desired positions on an upwardly extending J-bar which is part of the chair frame. In others, a manually operable rack-and-pinion type or ratchet type mechanism enables backrest height adjustment. Such prior mechanisms are typically relatively complex in constructions, costly to manufacture, trouble-prone, and unreliable in use. Protruding operating handles, levers or knobs are troublesome to manipulate or operate, and are visually unattractive and detract from the appearance of the chair.

SUMMARY OF THE PRESENT INVENTION

A height adjustment mechanism in accordance with the present invention enables a chair backrest to be manually raised or lowered to various vertical positions on the chair frame and relative to the chair seat and releasably locks the backrest in a selected one of the vertical positions. The mechanism comprises a guide member which is rigidly secured to a vertically stationary upright J-bar which is part of the chair frame and a channel member which is rigidly secured to the backrest and slidably mounted for vertical movement on the guide member. The guide member and channel member are slidably engaged with each other by tongue and groove connection means along their vertical edges. A latch bar and a coiled torsion spring are located in a cavity or space between the guide member and channel member. The latch bar is pivotably mounted on a pivot pin integrally formed on the guide member and carries a latch pin near one end which is disposed in a slot formed in an outer wall of the channel member. The coiled torsion spring has two divergent legs and is mounted in a recess formed in the guide member. One spring leg is anchored by entrapment to the guide member. The other spring leg engages and operates to bias the pivotable latch bar between a latched position and an unlatched (overcenter) position. The slot has a plurality of notches arranged vertically along one vertical edge thereof, including uppermost and lowermost notches defining, respectively, minimum and maximum height adjustment positions for the chair backrest. The latch pin can be biased in latched position into any one of the notches. The slot also has an inclined surface or ramp at its lower end which extends downwardly from the lowermost notch and is slidably engageable with the latch pin when the backrest and its attached channel member is manually raised by lifting beyond its maximum height position. Such lifting forces the latch pin out of engagement with the lowermost notch and causes the latch bar to pivot from latched position to unlatched (overcenter) position. The slot further has a cam surface along its opposite vertical edge, including a straight portion and a curved portion, which extends upwardly from the lower end of the inclined surface to the uppermost notch. The latch pin is biased against the cam surface when the latch bar assumes unlatched (overcenter) position. The straight portion of the cam surface enables the backrest to be manually lowered toward its minimum height position. In approaching the minimum height position, the curved portion of the cam surface acting on the latch pin causes the latch bar to pivot from unlatched (overcenter) position back into latched position wherein the latch pin then engages the uppermost notch so that the backrest is latched in its minimum height or lowermost position. Thereafter, manually raising the backrest and its attached channel member causes the latch pin to pivot slightly against the spring bias and slide from one notch to the next lowest notch wherein it remains biased and releasably engaged to lock the backrest in that particular position until the backrest is again lifted. Raising of the backrest can then be repeated, one notch at a time, until the desired height position is attained or until the latch bar again pivots overcenter, whereupon the backrest can be again lowered.

A height adjustment mechanism for a chair backrest in accordance with the present invention offers numerous advantages over the prior art. For example, the backrest itself is grasped and moved up or down and no separate external latch operating devices which require manipulation are required, such as levers, knobs or handles. Thus, the aesthetic appearance of the chair is not affected by such devices and complicated operating instructions for use of such devices are not required. Instead, the user merely grasps and raises or lowers the backrest itself to effect adjustment. Furthermore, the mechanism requires a minimum number of components which are simple to operate, compactly arranged, and easy and economical to manufacture. Its compactness enables the mechanism to be neatly installed in or on the backrest itself with minimum spatial requirements and so as to be easily concealed by upholstery or other forms of covering. The mechanism is designed so that operating elements and structural features required for operation are integrally formed, insofar as possible in the main components themselves. Thus, interengaging tongues and grooves enable slidable engagement of the guide member and channel member. The slot is formed in the channel member. The latch pin is integral with the latch bar. An integrally formed pivot pin on the guide member provides for pivotal support of the latch bar. Entrapment of the latch bar and torsion spring in a cavity between the guide member and channel member provides physical support, proper location, and guides and limits their motion. Such a design approach results in economy and simplification of manufacture, reduction of assembly steps, and over-all compactness. Furthermore, two separate pivot pins, one above the other, are provided on the guide member and either can be used to establish the position of the channel relative to the guide thus making for versatility and wider application. Other objects and advantages will hereinafter appear.

DRAWINGS

DESCRIPTION OF PREFERRED EMBODIMENTS

Figure 1:
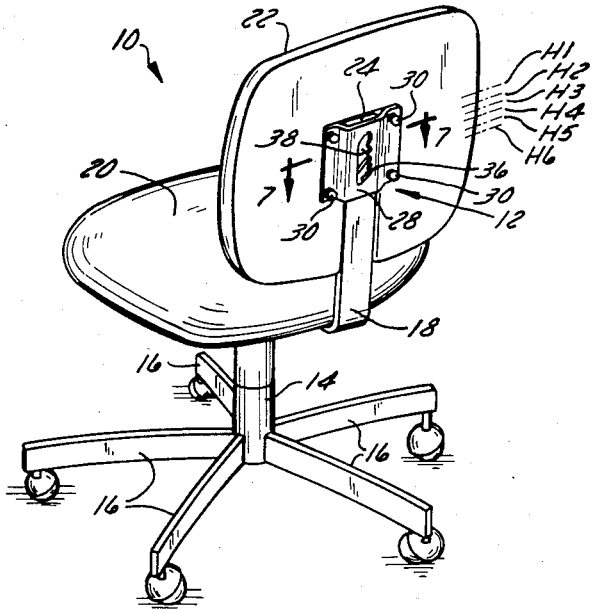
FIG. 1 is a left rear perspective view of a chair having a backrest height adjustment mechanism in accordance with the present invention.

Referring to FIG. 1, numeral 10 designates a chair employing a backrest height adjustment mechanism 12 in accordance with the present invention. Chair 10 comprises a supporting framework 14 to which legs 16 and a vertically stationary upright backrest support or J-bar 18 are attached. Chair 10 further comprises a chair component such as a seat 20 which is attached to framework 14 and a chair component such as a backrest 22 which is connected to and supported on J-bar 18 by means of mechanism 12. Seat 20 and J-bar 18 may be stationarily mounted on framework 14 or may be horizontally rotatable relative thereto, depending on chair design. Preferably, mechanism 12 is covered by suitable upholstery on the rear of backrest 22, but such is deleted in FIG. 1 to show details of the mechanism. Mechanism 12 is provided for releasably locking backrest 22 in any one of a plurality of desired vertical positions relative to seat 20 and to upright backrest support 18.

Figure 7:
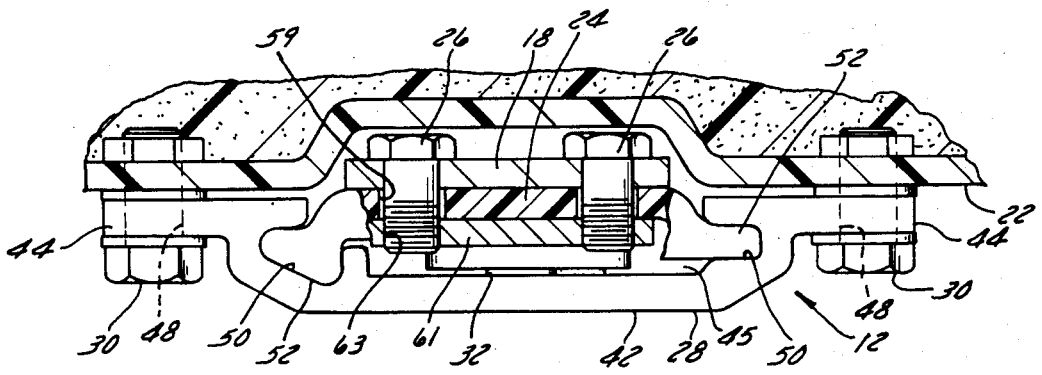
FIG. 7 is an enlarged cross-section view of the mechanism taken on line 7—7 of FIG. 1.
Figures 2, 3:
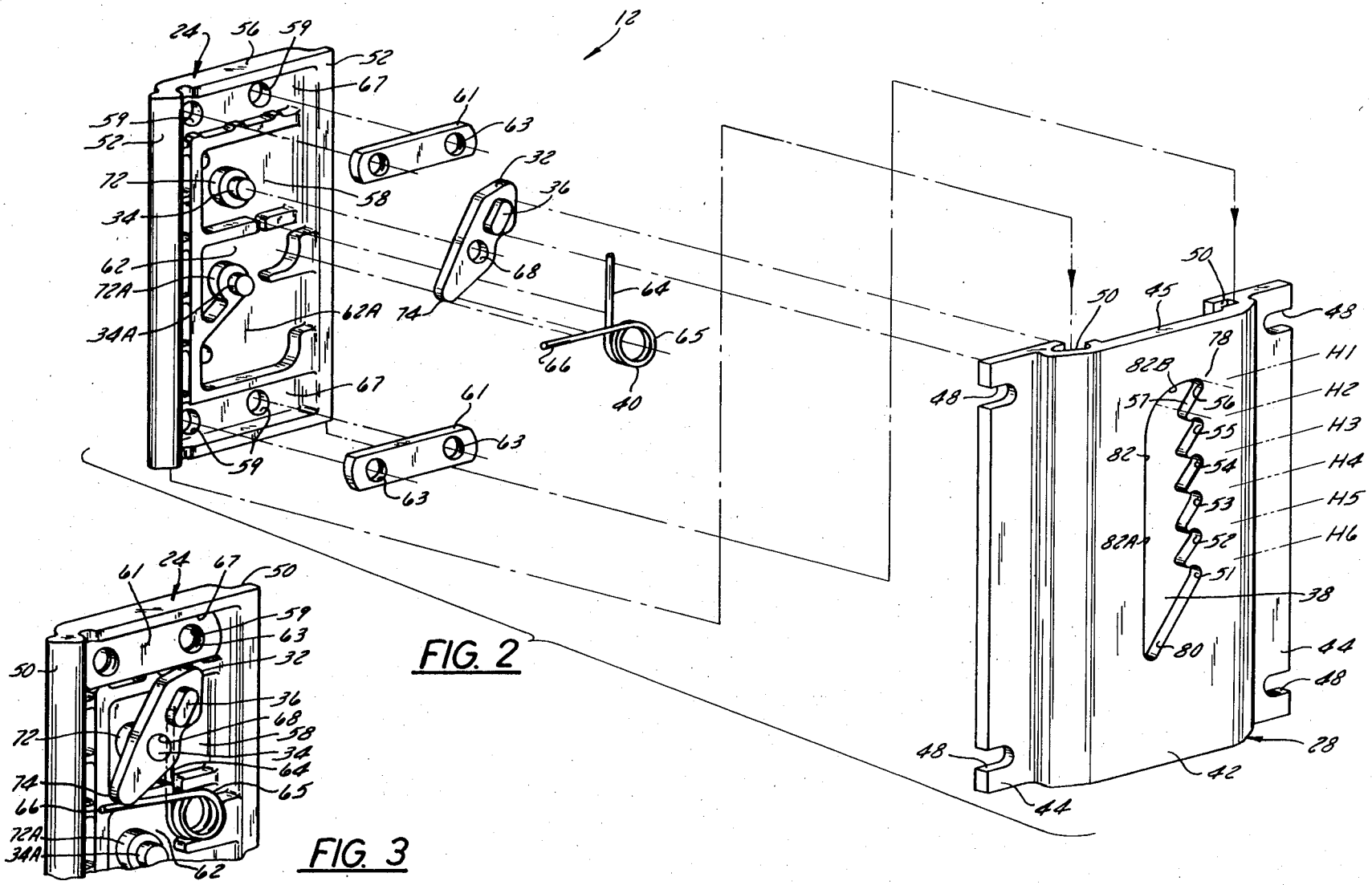
FIG. 2 is a greatly enlarged exploded perspective view of the mechanism of FIG. 1 which includes an internal guide member, external channel member, a latch bar having a latch pin and a torsion spring.
FIG. 3 is a perspective view of some assembled components of the mechanism of FIGS. 1 and 2.

As FIGS. 1, 2 and 7 show, mechanism 12 comprises a guide member 24 (hereinafter called "guide") rigidly secured to support 18 and a channel member 28 (hereinafter called "channel") rigidly secured to the backrest 22 and mounted for vertical sliding movement on guide 24. The channel 28 comprises a slot 38 having a plurality of vertically arranged notches 51 through 56, an inclined surface 80 sloping downwardly from the lowest notch 51, and a cam surface 82, including a straight portion 82A and a curved portion 82B, extending upwardly from the lower end of inclined surface 80 to the highest notch 56. A latch bar 32 is pivotally mounted on an upper pivot pin 34 (FIGS. 4 and 6) on guide 24 and has an integrally formed latch pin 36 at one end extending into slot 38. A torsion spring 40 mounted on guide 24 biases latch bar 32 in a latched position wherein latch pin 36 releasably engages any of the notches 51 through 56 to maintain backrest 22 at a selected height. Manually raising backrest 22 slightly above its highest latched position (wherein latch pin 36 engages lowest notch 51) engages inclined surface 80 with latch pin 36 to pivot latch bar 32 counterclockwise overcenter to spring-biased unlatched position. Then, manually lowering backrest 22 to its lowest position (defined by highest notch 56) while latch pin 36 engages straight portion 82A of cam surface 82 and subsequently curved portion 82B pivots latch bar 32 clockwise from overcenter unlatched position back to a latched position wherein latch pin 36 engages highest notch 56 to maintain backrest 22 in its lowest position. From there, backrest 22 can be lifted one notch at a time to any one of its raised positions wherein it is releasably locked.

In the embodiment disclosed, backrest 22 has six such height positions designated H1, H2, H3, H4, H5 and H6 in FIG. 1, with H1 and H6 designating extreme or minimum and maximum backrest height positions, respectively, and with H2 through H5 designating four intermediate height positions. Typically, the total vertical distance traversed by the top of backrest 22 between positions H1 and H6 is two and one-half (2.50) inches and is determined by the length of slot 38. However, a greater or lesser number of intermediate positions could be provided for, as well as a greater or lesser travel distance between positions H1 and H6. Backrest 22 is shown in intermediate height position H5 in FIG. 1.

As FIGS. 1, 2 and 7 show, mechanism 12 comprises rigid guide member or guide 24, which is rigidly secured to J-bar 18 by a plurality of screws 26, and rigid channel member or channel 28, which is rigidly secured to backrest 22 by a plurality of screws 30. Channel 28 is slidably mounted on guide 24. Latch bar member or latch bar 32 is pivotably mounted on an upper pivot pin 34 (FIGS. 2, 3, 4 and 6) on guide 24 and carries latch pin member or latch pin 36 which is disposed in a slot 38 formed in channel 28. Biasing means in the form of torsion spring 40 is mounted on guide 24 and engages pivotable latch bar 32 to maintain it in a latched (clockwise) position (FIG. 4) or an unlatched (overcenter, counterclockwise) position (FIG. 6).

Referring to FIGS. 2, 3, 4, 5, 6 and 7, channel 28 has a flat offset center section 42 in which slot 38 is formed and which has outer flanges 44 along its opposite vertical sides. The flanges 44 have screw slots 48 therealong for accommodating the screws 30 which secure channel 28 to the rear side of backrest 22. Offset center section 42 is spaced from backrest 22 to define a space 45 on the inner side of the channel which is open at its upper and lower ends for accommodating passage of the relatively stationary guide 24. Channel 28 is provided on its inner side with vertically extending grooves 50 on opposite sides of center section 42 which slidably engage vertically extending tongues 52 formed on the opposite side edges of guide 24, hereinafter described in detail. Channel 28, which is rigid, may be fabricated of metal or plastic which is extruded, machined or molded. In an actual embodiment, extruded aluminum was used.

Referring to FIGS. 2 through 7, guide 24, which is preferably formed by molding of plastic because of its intricate shape, has a center section 56 which has the aforementioned vertically extending outwardly projecting tongues 52 on its vertical opposite side edges for slidably engaging the grooves 50 in channel 28. The inner side 58 of center section 56 of guide 24 confronts space 45 defined by channel 28. Guide 24 is provided at its upper and lower ends with holes 59 for accommodating the screws 26 which secure the guide to J-bar 18. Two plates 61 with threaded holes 63 therein receive the screws 26 and serve as nuts. The plates 61 are received in recesses 67 formed in inner side 58 of guide 24. Side 58 is provided with a molded upper recess 62 for accommodating and entrapping one leg 64 and the coiled portion 65 of torsion spring 40 (see FIG. 3). The other leg 66 of torsion spring 40 is disposed in space 45 and engages latch bar 32.

Figure 4:
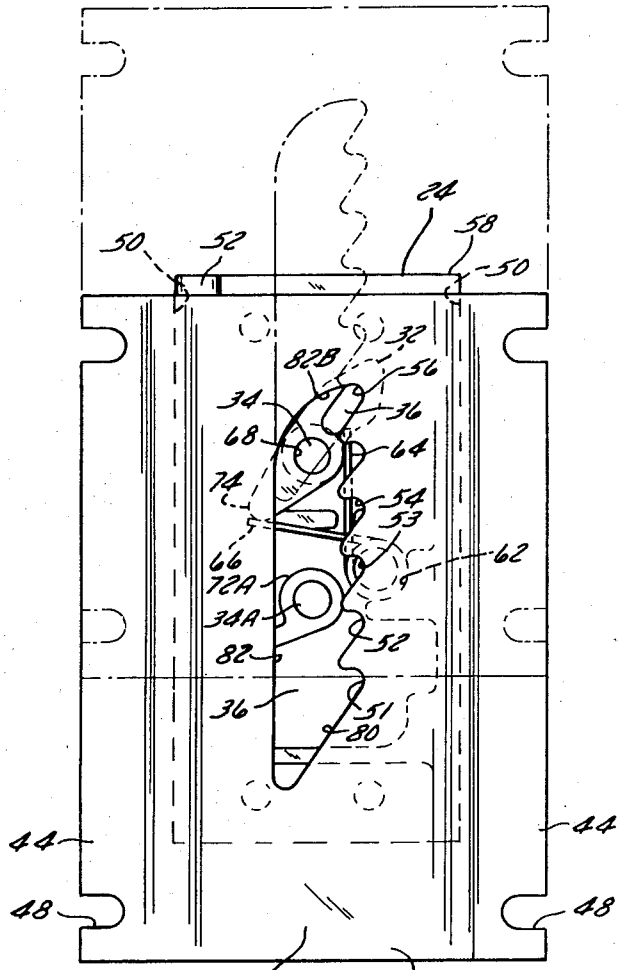
FIG. 4 is a plan view of the mechanism of FIGS. 1, 2 and 3.
Figure 6:
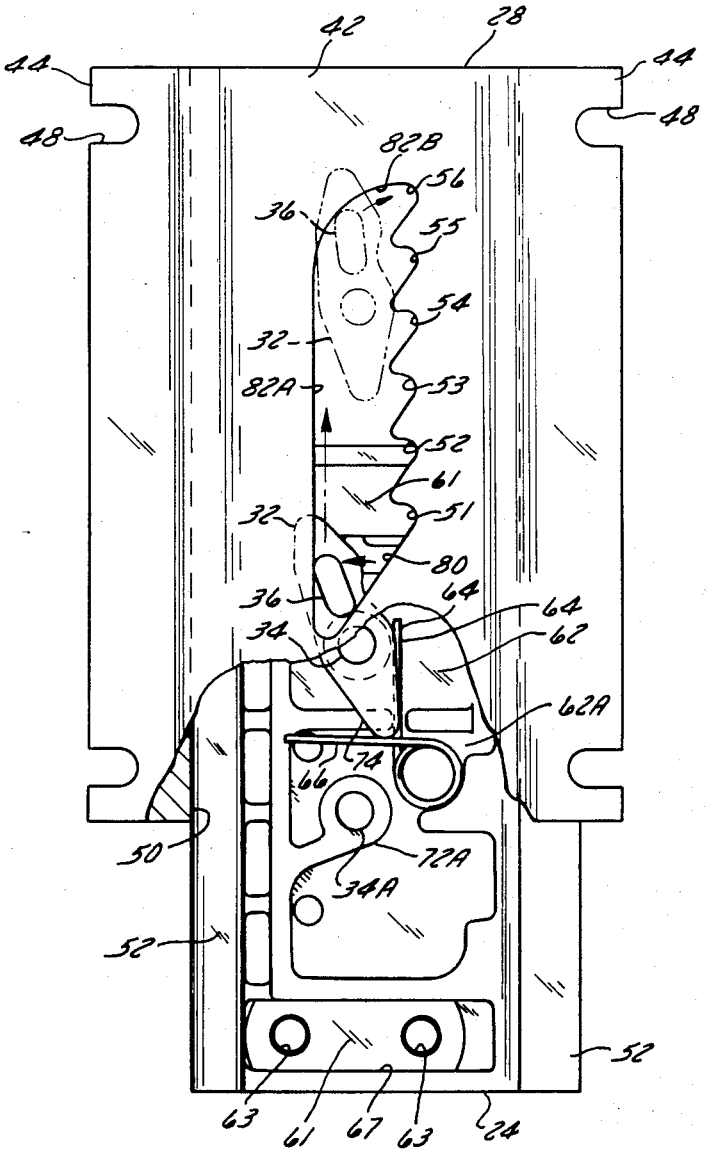
FIG. 6 is a plan view of the mechanism with a portion of the channel member removed to show interior details.

As FIGS. 3, 4 and 6 show, latch bar 32, preferably molded of plastic, has a hole 68 therethrough for receiving an upper pivot pin 34 which is integrally formed on an upper boss 72 which is integrally molded on the inner side 58 of guide 24. Latch bar 32 is pivotally movable on pivot pin 34 between latching and unlatching positions (i.e., clockwise and counterclockwise relative to FIGS. 4 and 6). The latch pin 36 is mounted on the upper end of latch bar 32 and extends outwardly therefrom into slot 38 in channel 28. The outer edge of the lower end of latch bar 32 has a generally triangular shape, rounded at its tip, and defines a surface 74 for engaging the leg 66 of torsion spring 40.

Figure 8:
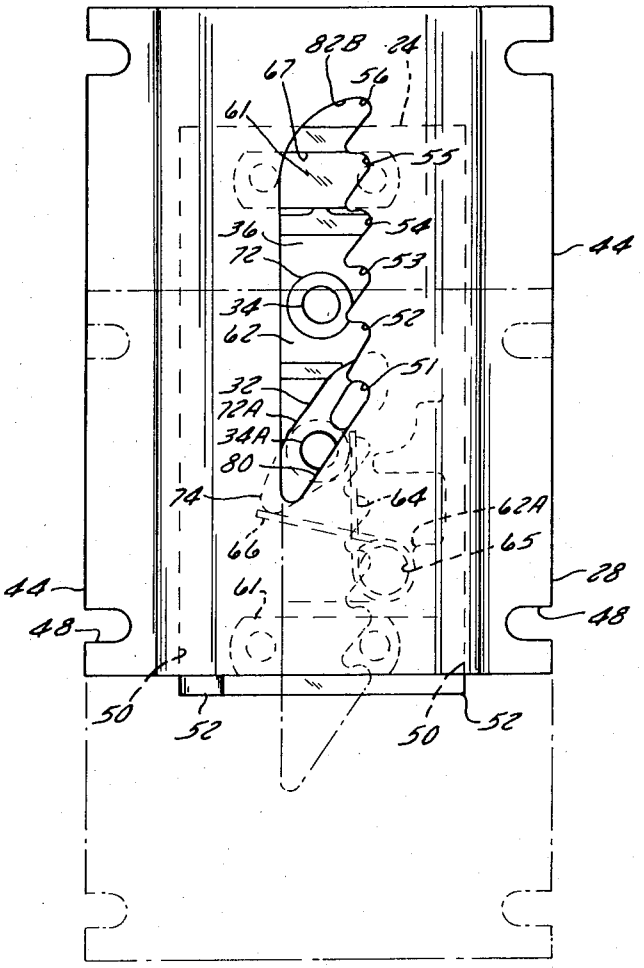
FIG. 8 is a view of the mechanism similar to FIG. 4 but showing the latch bar mounted in another position.
Figure 5:
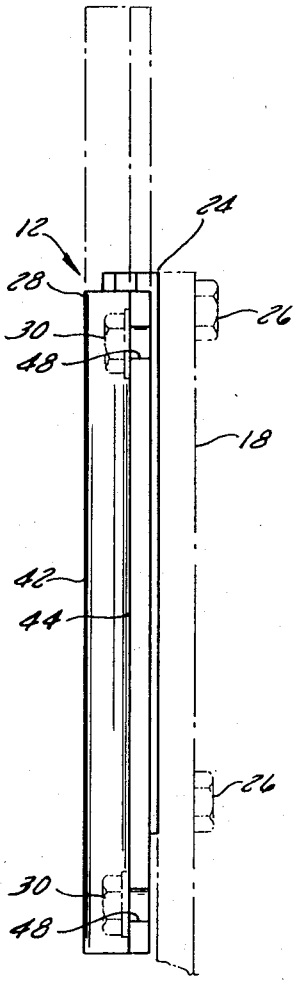
FIG. 5 is a side elevation view of the mechanism of FIG. 4.

As FIGS. 3, 4, 6 and 8 show, in addition to upper boss 72 and its upper pivot pin 34, the inner side 58 of center section 56 of guide is also provided with a lower boss 72A having a lower pivot pin 34A thereon and with a lower spring receiving recess 62A. As FIG. 8 shows, the aforedescribed latch bar 32 is mounted on lower pivot pin 34A instead of upper pivot pin 34. This is an optional arrangement which enables channel 28 and guide 24 to assume different positions relative to each other than is the case in FIG. 4 in order to take into account the need to apply mechanism 12 to a chair 10 in which the backrest 22 requires a mounting arrangement other than the arrangement of FIG. 4. However, mechanism 12 operates in substantially the same manner as regards latching if either pivot pin 34 or 34A is used.

Referring to FIGS. 2, 4 and 6, it is seen that slot 38 has a plurality of notches along one vertical edge 78, including uppermost and lowermost notches 56 and 51 defining, respectively, minimum and maximum height adjustment positions for backrest 22, with intermediate notches 52, 53, 54 and 55 therebetween defining intermediate height adjustment positions, and into which latch pin 36 can be biased in latching position. Each notch 51 through 56 has a downwardly sloping lower edge 57 shown in FIG. 2. Slot 38 also has the leftwardly and downwardly inclined surface or ramp 80 at its lower end which is engageable with latch pin 36 when backrest 22 is manually raised beyond its maximum latched height position H6 (lowest notch 51) to thereby cause latch bar 32 to pivot counterclockwise (see FIG. 6) from latched to unlatched (overcenter) position and out of engagement with any of the notches 51 through 56. Slot 38 also has the cam surface 82, with straight portion 82A and curved portion 82B, along its other vertical edge 84 against which latch pin 36 is biased (see FIG. 6) while latch bar 32 is biased in unlatched (overcenter) position. This enables backrest 22 to be lowered manually to its minimum height position H1. In approaching minimum height position H1, the curved portion 82B of cam surface 82 acting on latch pin 36 (see FIG. 6 phantom view) forces latch bar 32 to pivot clockwise from unlatched (overcenter) position and into latched position in engagement with uppermost notch 56 so that backrest 22 is latched in its lowermost position H1, from which it can be raised to other vertical positions H2 through H6.

As previously mentioned, torsion spring 40 biases latch bar 32 in a latched position wherein latch pin 36 releasably engages any of the notches 51 through 56 to maintain backrest 22 at a selected height. Manually raising backrest 22 causes latch pin 36 to slide off the sloping lower edge 57 of a notch (i.e., whichever notch 56 through 52 it is engaged with) as latch bar 32 pivots counterclockwise slightly and to then releasably engage the next lowest notch to position backrest 22 at the next highest position. This procedure can be repeated until latch pin 36 engages the lowest notch 51 and backrest 22 is in its highest position H6. As FIG. 6 shows, manually raising backrest 22 slightly above its highest latched position H6 (lowest notch 51) engages inclined surface 80 with latch pin 36 to pivot latch bar 32 overcenter to spring-biased unlatched position. Then, manually lowering backrest 22 to its lowest position H1 (highest notch 56) while latch pin 36 engages and tracks along cam surface 82 eventually pivots latch bar 32 from overcenter unlatched position back to a latched position wherein latch pin 36 engages highest notch 56 to maintain backrest 22 in its lowest position H1. From there, backrest 22 can be lifted one notch at a time to any one of its raised positions wherein it is releasably locked.

As FIG. 4 makes clear, when latch bar 32 is in latched position, leg 66 of torsion spring 40 engages a portion of surface 74 on latch bar 32 so as to bias the latch bar in the clockwise direction. But, when latch bar 32 is pivoted counterclockwise to overcenter unlatched position, as hereinbefore explained, spring leg 66 engages a portion of surface 74 so as to bias latch bar 32 in the counterclockwise direction. The lower end or tip of latch bar 32 is rounded to facilitate its motion along spring leg 66 as it moves between latched and unlatched positions (compare FIGS. 4 and 6).

As FIGS. 2, 3 and 7 make clear, latch bar 32 is maintained on pivot pin 34 of guide 24 by the entrapping action of center section 42 of channel 28 and embossment 72 of guide 24. Torsion spring 40 is similarly entrapped, although the space 45 between the inner side 58 of guide 24 and the innerside of offset center section 42 of channel 28 provides sufficient clearance for movement of those components i.e., latch bar 32 and torsion spring leg 66.

It is to be understood that inclined surface 80 and cam surface 82 along the edges of slot 38 taken together define a cam means or cam surface cooperable with latch pin 36 for moving latch bar 32 between latched position and unlatched overcenter position.

As will be understood, although the guide member is shown as rigidly secured to a support (J-bar) and the channel member is rigidly secured to the backrest, in order to allow for greater versatility in the mounting arrangement, the mechanism could also be attached so that the channel member is secured to the support (J-bar) and the guide member is secured to the backrest.

Furthermore, on many chairs the backrest structure pivots about the support (J-bar). Therefore, although the mechanism is disclosed as being rigidly secured to the J-bar and rigidly secured to the backrest, one member (the guide or channel) could be pivotally (or flexibly) secured to the backrst or the "J-bar" and the other member could be rigidly secured to the remaining chair structure.

As will be apparent, the mechanism is not limited solely to application in chairs, although this is the preferred embodiment. The mechanism could be utilized in any application where a means of adjustment for two components is required and the latch bar may, in some cases, be biased only in one direction.

I claim:

1. An adjustment mechanism (12) mountable on a chair (10) for releasably locking one chair component (22) in any one of a plurality of positions relative to another chair component (20) and relative to a support (18) which is part of the chair (10), comprising:

a guide member (24) which is adapted to be rigidly secured to said support (18);

a channel member (28) which is adapted to be rigidly secured to said one chair component (22) and which is mounted on said guide member (24) for sliding movement between two extreme positions; and latching means for releasably latching said channel member (28) and said one chair component (22) secured thereto in either of said two extreme positions or in intermediate positions therebetween in response to manual movement of said one chair component (22);

said latching means comprising a slot (38) on said channel member (28), said slot (38) having a plurality of notches (51–56) along one side, an inclined cam surface (80) along one end, a curved cam surface (82B) along the other end, and an intermediate cam surface (82A) along the other side; a latch bar (32) mounted on said guide member (24) for pivotal movement in a plane parallel to a plane in which said slot (38) lies and having a latch pin (36) thereon extending transversely into and remaining in said slot (38); and biasing means (40) connected between said guide member (24) and said latch bar (32) for biasing said latch bar (32) and latch pin (36) thereon alternately in a latched position wherein said latch pin (36) engages a notch (51–56) or an unlatched position wherein said latch pin (36) engages one of said cam surfaces (80, 82A, 82B);

said one chair component (22) being manually movable in one direction when said latch bar (32) is in latched position to move said latch pin (36) out of engagement with one notch and into engagement either with an adjacent notch or with said inclined cam surface (80) so that said latch bar (32) is moved from latched to unlatched position by said inclined cam surface (80);

said one chair component (22) also being manually movable in an opposite direction when said latch bar (32) is in unlatched position to move said latch pin (36) from said inclined cam surface (80), along said intermediate cam surface (82A) and along said curved cam surface (82B) so that said latch bar (32) is moved from unlatched to latched position by said curved cam surface (82B).

2. An adjustment mechanism according to claim 1 wherein said guide member and said channel member comprise interengaging means for slidably mounting said channel member on said guide member and wherein said latch bar is disposed between said guide member and said channel member.

3. An adjustment mechanism according to claim 2 wherein said latch bar is pivotally mounted on a pivot pin which is mounted on said guide member.

4. An adjustment mechanism according to claim 3 wherein said guide member comprises a pair of spaced apart pivot pins and wherein said latch bar is adapted to be mounted on either of said pivot pins.

5. An adjustment mechanism according to claim 3 wherein said biasing means is disposed between said guide member and said channel member and located in a recess formed in said guide member.

6. An adjustment mechanism according to claim 2 wherein said biasing means is disposed between said guide member and said channel member.

7. An adjustment mechanism according to claim 1 wherein said one chair component (22) is a backrest which is vertically movable up and down to effect corresponding vertical movement of said channel member (28).

8. An adjustment mechanism according to claim 7 wherein said slot (38) is vertically disposed and wherein said inclined cam surface (80) is at the lower end of said slot (38) and said curved cam surface (82B) is at the upper end of said slot (38).

* * * * *